United States Patent [19]

Principe et al.

[11] 3,930,281

[45] Jan. 6, 1976

[54] FLOOR CLEANING MACHINE

[75] Inventors: Rene Principe, Wil; Karl Kaser, Glattbrugg, both of Switzerland

[73] Assignee: A. Sutter AG, Munchwilen, Switzerland

[22] Filed: July 16, 1974

[21] Appl. No.: 488,981

[30] Foreign Application Priority Data

July 25, 1973 Switzerland ..... 10858/73

[52] U.S. Cl. ..... 15/320; 15/352; 15/353

[51] Int. Cl.[2] ..... A47L 7/00

[58] Field of Search ..... 15/320, 339, 352, 353

[56] References Cited

UNITED STATES PATENTS

| | | | |
|---|---|---|---|
| 2,233,167 | 2/1941 | Hansen | 15/353 |
| 3,165,774 | 1/1965 | Barba | 15/353 X |
| 3,177,635 | 4/1965 | Cawl et al. | 15/339 X |
| 3,290,865 | 12/1966 | Scrou et al. | 15/353 X |
| 3,550,181 | 12/1970 | Dolan et al. | 15/353 X |
| 3,552,100 | 1/1971 | Ekenberg | 15/353 X |

*Primary Examiner*—Daniel Blum
*Assistant Examiner*—C. K. Moore
*Attorney, Agent, or Firm*—Anthony A. O'Brien

[57] ABSTRACT

A floor cleaning machine constructed as a carriage equipped with a pole and having at least one motor-driven cleaning implement or tool rotating about a vertical axis and for wet cleaning the floor or the like. From a fresh water supply per unit of time there flows-out a regulatable quantity of fresh water to which there is added a cleaning agent, this mixture flowing-out at the region of the cleaning implement or tool. The machine works the floor or the like with the fresh water-cleaning agent mixture by means of the cleaning implement and the thus resulting soiled water is sucked-up from the floor and collected in a separate soiled water container. The fresh water container which supplies the fresh water is formed by part of the machine housing body, whereas the soiled water container is constituted by a separate, portable container which when assuming its working position is enclosed in the machine housing. This soiled water container is connected via a seal to the suction compartment of a suction blower and is protected from over filling by means of an automatically operating level limiting device. Further, means are provided to ensure that the water of the mixture of air and soiled water which enters the machine does not contact the suction blower and also prevent the splashing water of the soiled water container which may splash around during movement of the machine from entering the suction blower.

15 Claims, 5 Drawing Figures

FLOOR CLEANING MACHINE

BACKGROUND OF THE INVENTION

The present invention relates to a new and improved construction of floor cleaning machine constructed in the form of a carriage or mobile car equipped with a shaft or center pole and having at least one motor-driven cleaning implement or tool, such as a brush or pad, rotating about a substantially verical axis for the wet cleaning or scrubbing of the floor or the like. The cleaning machine of this development is of the type wherein a regulatable quantity of fresh water which is admixed with a suitable cleaning agent flows-out from a fresh water supply per unit of time to the region of the cleaning implement or tool, the cleaning machine then works such fresh water-cleaning agent mixture by means of the cleaning implement on the floor and the resultant soiled or contaminated water is sucked-up from the floor and collected in a separate soiled or contaminated water container. The invention particularly also relates to features of components belonging to the air-water circulation system.

Equipment of the aforementioned type are partially employed in those situations where it is cumbersome to travel each time with the machine to the next drain and to a water tap, for instance when traveling over door thresholds, stairs and so forth, for the purpose of emptying the contaminated or soiled water container and replenishing the fresh water supply. Hence, machines have become known to the art wherein the water containers can be disconnected from the machine and are portable. If the containers are fixedly installed in the machine then there is required as an accessory device a separate portable container.

Machines having two loose containers impair the compactness, yet however are required in use because both the spatial requirements (available space), the surface dimension (cleaning) and the weight (transport, handling, material costs) should be maintained as small as possible.

SUMMARY OF THE INVENTION

Hence, it is a primary object of the present invention to provide an improved construction of floor cleaning machine which is not associated with the aforementioned drawbacks and limitations of the prior art constructions.

A further object of the invention aims at the provision of a new and improved construction of floor cleaning machine which is relatively simple in construction and design, extremely reliable in operation, and is equipped with only one portable container, specifically the container for the soiled water being portable.

Now in order to implement these and still further objects of the invention, which will become more readily apparent as the description proceeds, the invention contemplates that only one of both containers is portable, and sepecifically the soiled water container. This container then can be carried, without the need for initially emptying the same into another container, to the drain, emptied, flushed and again filled with fresh water and carried back to the machine where its contents are then poured into the fresh water tank or container, the emptied soiled water container then being capable of again receiving the soiled or dirty water.

This solution permits of a considerably more compact construction of the machine than if there were employed two portable containers since it is unnecessary to design the equipment such that the fresh water tank need be portable. It can possess, for instance, a large surface area and a shallow depth and, with the exception of a closable infeed connection, can be closed at all sides. The invention makes use of such features in that the fresh water tank can be integrated into the machine housing in such a way that it forms part of the housing, i.e. is formed by walls of the housing and an intermediate floor which is arranged internally of the housing.

In order to impart to the machine the form of a closed body, notwithstanding the use of a loose or detachable soiled water container, the soiled water container is accommodated in a compartment of the machine housing which can by means of a suitable access door be opened or closed. Hence, according to the invention the side wall door, providing access to the soiled water compartment, is constructed such that it facilitates the removal of the filled soiled water container as well as also the loading of the machine with the soiled water bucket. For this purpose the door is constructed as a drop-door which when in its open pivoted condition forms a platform protruding from the machine at the elevation of the floor of the soiled water compartment, so that the container can be pulled out of the machine and reinserted therein without the need to overcome any elevational differences. According to the invention the drop-door is equipped with a movable floor support which, when the door is closed, is located surface-flush in a recessed position in the door.

A further aspect of the invention contemplates transmitting the movement of the drop-door, i.e. the closing and opening thereof, by means of a lever mechanism (not shown) to the compartment floor which supports the soiled water container. If the door is closed then the compartment floor is raised until a seal between the soiled water container edge and the housing-fixed compartment ceiling is subjected to pressure and thus connects in an air tight fashion the container with the suction compartment of a suction blower. If the door is opened then the compartment floor is lowered until the soiled water container in the compartment has sufficient elevational play that it can be easily pulled out of the compartment and again re-introduced therein.

Further features of the invention reside in the fact that such seal is neither mounted at the soiled water container nor at a housing-fixed part, rather at an intermediate element which is loosely mounted at the edge of the container and which upon removal of the container from the machine compartment is removed therewith. Further, this intermediate element carries parts of the level limiting device which protects the soiled water container from being over filled and that upon non-contact of the intermediate element with the edge of the container a quantity of false or dummy air flows into the negative pressure compartment of the blower so that the suction force of the blower is no longer adequate in order to suck-up the water from the floor. With this inventive combination of the seal with a part of the overflow portection mechanism there is ensured for protection against overflow even in the case of an error on the part of the operator.

As far as the mechanism for protecting against overflow the intermediate element advantageously carries of such mechanism only a float, whereas the remaining components are mounted within the compartment at the housing. If the level of the soiled water has reached the maximum permissible extent, then the float which is guided to be vertically movable at the intermediate element, raises a closure valve out of its rest position. If the closure or shut-off valve has moved out of the rest position, then it is exposed to the suction action of the suction air current or stream which then moves the same through the remainder of its stroke until it reaches the closed position.

The suction conduit, which transports the mixture of contaminated water and air from the floor suction nozzle into the soiled or contaminated water compartment, must be introduced into the compartment such that there is brought about the best possible separation of the contaminated or soiled water and the air. For this purpose this suction conduit opens laterally into the suction compartment which spans over the soiled water container. On the other hand, the suction air conduit which leads to the suction blower opens at least approximately at the vertical central axis of the soiled water container into the aforementioned suction compartment.

Between the lateral opening of the soiled water-suction conduit and the centrally positioned exit opening of the suction air conduit there extends a mechanism in the form of a collarshaped screen which terminates at the compartment ceiling. This collar-shaped screen becomes progressively wider from the region of its upper end which meets with the ceiling downwardly towards what is termed a drip edge and optimumly approaches the contour of the upper edge of the soiled water container. The lateral horizontal inflowing soiled water stream is sub-divided by a guide surface and owing to the downwardly and outwardly inclined collar surface each half of the divided stream flushes one-half of the periphery of the annular compartment which is formed by the lateral suction compartment wall and the collar or collarshaped screen. Further, the soiled water, which owing to its specific weight separates from the suction air, drops down over the entire periphery of the collar edge towards the wall of the soiled water container and along such into the container.

Furthermore, the water which flows downwardly along the wall exerts a braking action upon the backwater which tends to rise along the container wall. Additionally, the upwardly ascending splashing water impacts against the inside of the collarshaped screen which, according to a further function of the invention, maintains the splashing water out of contact with the air suction conduit leading to the blower.

Continuing, it should be recognized that according to the invention the suction conduit or line which leads from the suction compartment via the soiled water container to the suction blower extends through the agency of a labyrinth-type sequence of flow compartments and is subjected to a multiplicity of directional deflections for the purpose of completely separating the air and water.

For the purpose of separating the smallest water particles out of the air stream a large surface filter is mounted in the labyrinth-type sequence of flow compartments.

In compliance with a basic concept of the invention according to which only the soiled or contaminated water container is constructed to be portable, the emptying of the fresh water tank or container occurs likewise by means of the soiled water container in which there can be carried away the fresh water. For this purpose the suction hose, which removes the soiled water from the floor nozzle, is coupled to the latter and with an emptying connection or stud connected with a riser pipe in the fresh water tank. In this way it is possible with the same suction blower, which generates the working suction load for the floor cleaning machine, to pump the excess fresh water into the soiled water container.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figures 1A, 1B, 1C:
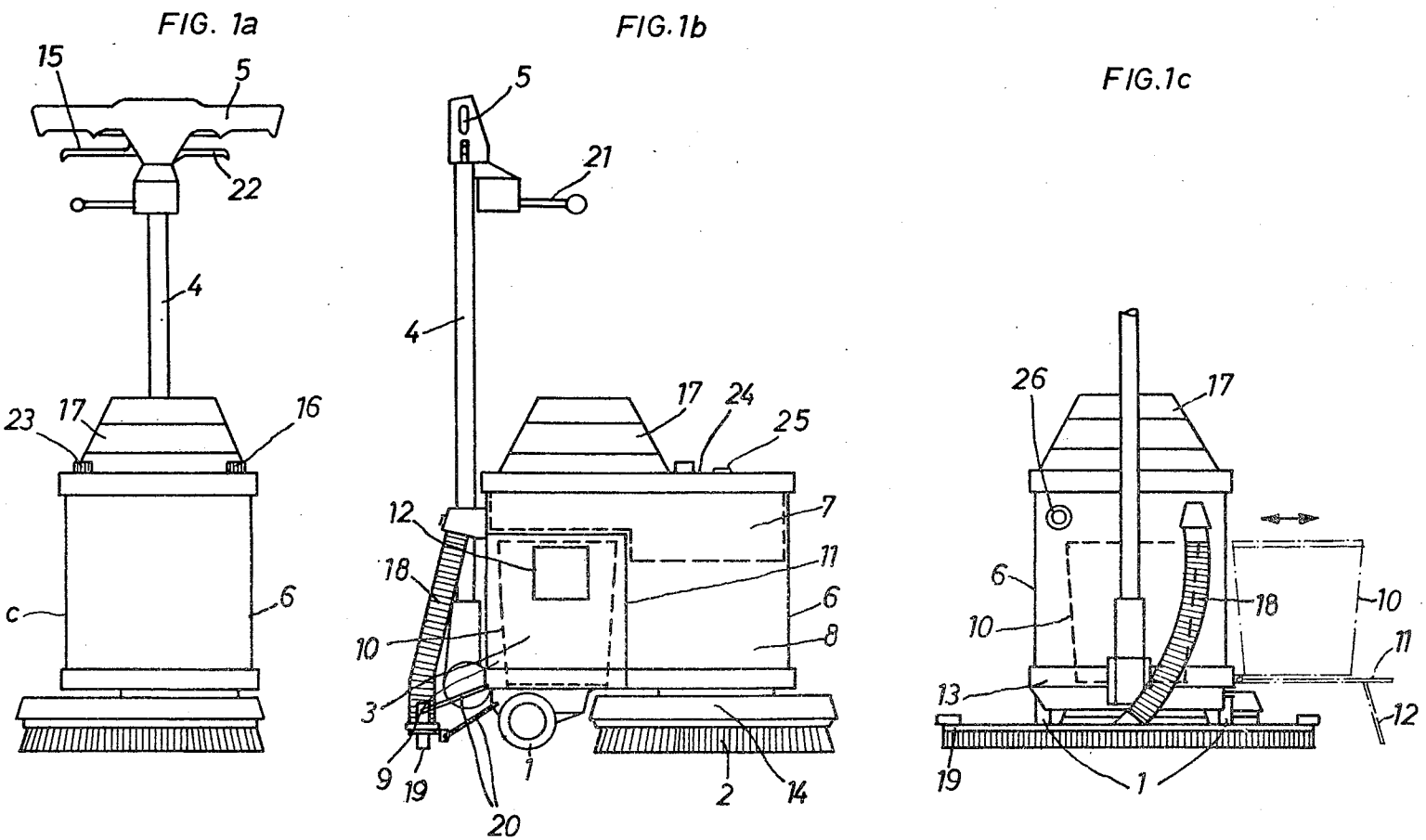
FIG. 1*a* is a schematic front view of the floor cleaning machine designed according to the invention.
FIG. 1*b* is a side view of the floor cleaning machine depicted in FIG. 1*a;*
FIG. 1*c* is a rear view of the floor cleaning machine depicted in FIG. 1*a;*
Figure 2:
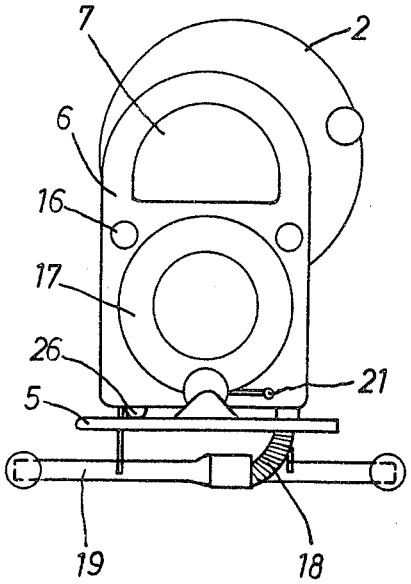
FIG. 2 is a plan view of the floor cleaning machine shown in FIGS. 1*a* to 1*c.

Describing now the drawings, the floor cleaning machine portrayed in FIGS. 1*a* to 1*c* and FIG. 2 and constructed as a mobile carriage or car C bears through the agency of two traveling rollers 1 and a substantially disk-shaped working implement or tool 2, for instance a brush or pad, upon the floor or surface to be treated. This floor cleaning machine will be seen to further comprise a guide shaft or center pole 4 which is mounted to be pivotable about a horizontal shaft or axle 3 and such center pole is equipped with a handgrip 5 carrying various control elements. Further, the floor cleaning machine embodies a machine housing 6, the upper portion of which forms the fresh water tank or container 7, and beneath which there is enclosed by means of the cleaning implement or tool 2 a drive motor 8. The machine housing 6 accommodates a transportable or portable soiled water bucket or container 10 within a surface-flush closable compartment 9.

According to the invention the soiled water container or bucket 10 is constructed as a transportable and portable vessel by means of which the soiled or contaminated water can be conveniently carried to a suitable drain and a supply of fresh water obtained. Upon removal of the soiled water container 10 from the compartment 9 the compartment cover 11 which is constructed as a drop or pivotable door, hereinafter simply referred to as a drop-door, is pivoted down into a substantially horizontal position where this door is then supported by the floor through the agency of extendable cover supports or support means 12. In this position the drop-door 11 forms a platform located at the elevation of the compartment floor 13, so that the container or bucket 10 can be conveniently shifted by means of the platform 11 into and out of the compartment 9 without having to overcome any differences in height.

When the machine is in operation the cleaning tool 2 rotates about its vertical axis of rotation 14, driven by its drive motor 8. Upon actuating the lever 15 at the guide handgrip 5 fresh water to which there has been admixed a suitable cleaning agent flows out of the fresh water tank towards the region of the cleaning implement or tool 2 and then onto the floor or the like. The quantity of fresh water which flows-out per unit of time can be adjusted by means of a regulating knob 16 of a standard quantitative regulator. The cleaning tool works the liquid over the floor to be cleaned so as to clean the same and thereby forms from the fresh clean water the contaminated water containing the particles or contaminants which have been removed from the floor. This soiled or contaminated water which is subjected to the action of a suction blower 17 which is loosely mounted on the machine housing 6 is sucked-up through the agency of a flexible hose connection 18 by means of a floor suction nozzle or nozzle arrangement 19 which is laterally and elevationally movable and such sucked-up soiled water is then collected at the soiled water container 10. The elevational- and lateral movements of the floor suction nozzle arrangement 19 occur automatically owing to the provision of the parallelogram suspension system 20 and is automatically accommodated to the contour of the floor. By means of the nozzle actuation lever 21 it is possible to raise the nozzle from the floor and to again lower such towards the floor.

The guide pole 4 automatically engages by means of a suitable ratchet mechanism which has not been particularly shown and may be conventional in design, in vertical position and in a comfortable working elevational position. By means of the lever 22 at the guide handgrip 5 it is possible to release such locking or ratcheting action. In order to ensure that the work tool 2, which in addition to the two guide rolls 1 carries the machine, always bears with its entire surface against the floor or other surface to be treated irrespective of the degree of wear of such work tool, its position can be adjusted at the leveling knob 23.

The fresh water tank or container 7 is equipped at the cover surface 24 of the machine housing 6 with a filling or infeed opening 25 and at the housing wall at the side of the center pole with an emptying connection or stud 26. This emptying connection 26 is operatively coupled with a riser conduit or pipe in the fresh water tank and is not particularly visible in the drawing. For the purpose of emptying the fresh water tank the flexible suction conduit 18 is separated from the floor suction nozzle arrangement 19 and connected with the emptying connection or stud 26, whereafter the suction blower 17 pumps the contents of the fresh water tank 7 into the soiled water container 10.

Figure 3:
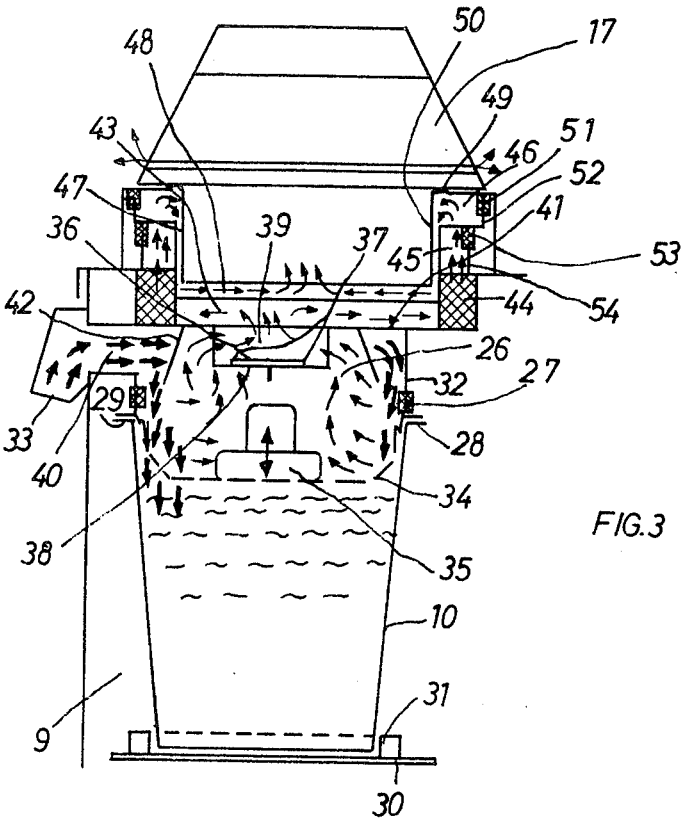
* and FIG. 3 is a vertical sectional view through the soiled water container with the overflow protection device and the air flow labyrinth for the water separation.

In the work position of the floor cleaning machine (FIG. 3) the soiled or contaminated water container 10 is connected in an air tight fashion with the suction compartment 26′ of the suction blower 17. The air tight connection is established by means of a compressible sealing ring 27, this sealing ring being seated at an intermediate element or piece 29 which is loosely mounted upon the soiled water container edge or marginal portion 28. This seal 27 is subjected to a contact pressure when the drop-door 11 of the soiled water compartment 9 is closed in that the drop-door 11 is coupled via a lever mechanism (not shown) with the compartment floor 13 in such a way that upon closing the door 11 the floor 13 is raised until the seal 27 is subjected to an appropriate pressure or compression and upon opening, i.e. downwardly pivoting the drop-door 11, the compartment floor 13 is lowered to such an extent that the seal is no longer compressed and the soiled water container 10 possesses sufficient play that it can be easily removed and reinserted. During the reinsertion of the soiled water container 10 into the soiled water compartment 9 such is caught by lateral guides 31 until it impacts at the rear, whereafter it is fixedly held in its position shown in plan view such that the seal 27 fits at its upper counter-support or position 32. The suction compartment or chamber 26′ and the soiled water compartment 9 is equipped with an inflow connection or stud 33 which is coupled by a flexible hose conduit 18 with the floor suction nozzle or nozzle arrangement 19.

The substantially ring-shaped intermediate element 29 carries a float 35 on a bracket 34 which traversely extends over the soiled water container and serves to laterally guide the float but so as to be movable in vertical direction. As the water level in the soiled water container 10 increases the float 35 at a certain height of the water level also begins to ascend and shifts a closure or shut-off valve 36 which in its normal work position is open out of its rest position in which it is located in a seat or fixture 38 formed by a collar 37. If the valve 36 is lifted out of the seat 38, then it is exposed to the suction action of the air current which flows through the valve opening 39 in the direction of the suction blower 17 and is entrained by such air current until it closes the valve opening 39. Consequently, the soiled water container is protected against over filling and overflowing If the soiled water container 10 is pulled out of the compartment 9, then the intermediate element 29 comes out along therewith and —since it is only loosely mounted— during handling of the bucket it is removed at the faucet or water supply or the like. If the intermediate element or piece 29 upon reinsertion of the container 10 into the soiled water compartment 9 of the housing 6, for instance is inadvertently not again mounted at the container edge 28, then between the container edge 28 and the counter support or counter position 32 of the intermediate element seal 27 there is formed an air gap through which so much false or dummy air then flows into the suction compartment or chamber 26′ that the suction blower is no longer capable of sucking-up any water through the inflow connection or stud 33. The overflow protection is therefore equally provided even in the absence of the intermediate element carrying the float.

The mixture of the soiled water and air, which is sucked-up through the inflow or inlet connection 33 —viewed in plan view— arrives at the lateral edge in the suction compartment via the soiled water container. In the exemplary embodiment such container and therefore also the suction compartment which is located thereover possesses in horizontal cross-section the configuration of a rectangle with rounded edges. In this example the inflow connection or stud 33 extends at one corner horizontally into the suction compartment or chamber 26′. On the other hand, the air outlet 39 opens in the direction of the suction blower 17 approximately at the vertical central axis of the soiled water container 10 from such suction compartment 26′.

Between the inflow mouth 40 and the outflow mouth 39 there extends completely around i.e. closed upon itself, a collar-shaped screen 42 which merges with the ceiling 41 of the suction compartment 26'. This collar-like screen 42, sometimes also referred to simply as a collar 42, becomes wider towards the bottom and therefore fulfills two functions:

A. The soiled water stream or jet which enters in the corner of the suction compartment or chamber 26' is sub-divided into two halves by means of a guide surface (not shown) arranged at that location and only visible in plan view, and wherein each such half of the water jet flushes about one-half of the collar circumference. The inclination of the collar surface 42 downwardly and outwardly produces the result that the water which falls under the action of gravity is guided towards the jacket surface of the soiled water container or bucket and therefore arrives in the bucket with the largest possible spacing from the air suction opening 39, thereby predominantly reducing the danger of the entry of soiled water into the blower.

B. The soiled or contaminated water which falls along the entire periphery of the wall of the bucket or container breaksup ascending back water of any water which is splashing around within the bucket. If there is still some ejected splashing water such is nonetheless held out of contact with the air exit by means of the collar 42.

The further course or extent of the suction air conduit from the outflow mouth or exit 39 out of the suction compartment 26' into the soiled water compartment 9 upto the blower 17 is guided in a labyrinth-like fashion, i.e. equipped with a multiplicity of changes in direction- and cross-section, and producing a separation of the residual water which the air possibly entrains, and furthermore there is arranged in such air current a filter which blocks the finest water particles. Thus, the aforesaid valve opening 39 leads to a substantially disk-shaped compartment 43, from which the air departs through a substantially ring-shaped, relatively large-surface filter body 44, then through the ring-shaped compartments or chambers 45 and 46, then through a circular ring-shaped compartment 47, again throught a disk-shaped compartment 48 and finally to the suction blower 17.

The suction blower 17 is loosely mounted upon the sealing opening edge 49. After removal of the blower 17 there is exposed a substantially pot-shaped or pot-like body 50 which bears by means of its flexed upper edge against the ring-shaped seal 51 of a second pot-shaped element 52 and can be likewise lifted off. The pot-shaped element 52 in turn bears against the seal 53 of the round pot-shaped element 54 and similarly can be lifted-off. By removing or lifting-off the pot-like body forming the individual guide surfaces it is possible to control the air flow compartments or chambers and to thus remove any water which has possibly been separated out from the air.

While there is shown and described present preferred embodiments of the invention, it is to be distinctly understood that the invention is not limited thereto but may be otherwise variously embodied and practiced within the scope of the following claims. ACCORDINGLY,

What is claimed is:

1. A floor cleaning machine constructed as a carriage equipped with a guide pole, at least one motor-driven cleaning tool for wet cleaning the floor and rotating about a substantially vertical axis, a regulatable quantity of fresh water admixed with a cleaning agent being delivered per unit of time from a fresh water supply to the region of the cleaning tool, the cleaning tool processing the delivered fresh water admixed with the cleaning agent at the floor and the resultant soiled water being sucked-up from the floor and collected in a separate soiled water container, the improvement comprising: a machine housing, a suction blower mounted on said housing, a fresh water container formed by part of the machine housing, the soiled water container comprising a loose portable container which is enclosed in the floor cleaning machine when it assumes a working position within the floor cleaning machine, a suction compartment having an air entrance aperture, the soiled water container being connected via a seal with said suction compartment, said seal comprising a marginal edge formed on said soiled water container, the edge of said suction compartment aperture, and a detachable intermediate element engaging both said suction chamber aperture edge and said marginal edge, an automatically-operating level limiting device for preventing the soiled water container from over filling, a downwardly inclined collar extending within said suction chamber, the incoming air and soiled water sucked-up from the floor by said suction blower being directed against said inclined collar, the soiled water flowing downwardly on the surface of said collar and into the said soiled water container, and a plurality of flow direction changing members mounted above said suction compartment for changing the direction of travel of the air and entrained water particles therein to thereby prevent said entrained water particles from entering said suction blower.

2. The floor cleaning machine as defined in claim 1, wherein said intermediate element supports at least one component of the level limiting device which prevents the soiled water container from over filling.

3. The floor cleaning machine as defined in claim 1, wherein the level limiting device comprises a float elevationally movably guided and supported by the intermediate element and at the region of the maximum permissible level of the soiled water said float comes into contact with and displaces a valve body which closes a suction opening in the suction compartment and thus suppresses the inflow of further mixture of air and soiled water into the said housing.

4. The floor cleaning machine as defined in claim 3, wherein the ascending float cooperates with a valve body to shift the same out of a rest position, and wherein after a starting displacement of the valve body out of the rest position the remaining path of the stroke of the valve body until completely closing a valve opening is undertaken by the action of the suction air current independently of the float.

5. The floor cleaning machine as defined in claim 1, wherein the intermediate element is constructed such that when the intermediate element is not installed on the floor cleaning machine there is formed an auxiliary flow branch of a size sufficient to prevent the suction blower from further sucking-up soiled water from the floor.

6. The floor cleaning machine as defined in claim 1, wherein the machine housing includes a compartment in which there is accommodated the soiled water container when it assumes its work position, a cover for selectively closing and exposing said machine housing compartment, means for mounting said cover to be pivotable towards the outside of said housing about a substantially horizontal axis, said pivotable cover in its pivoted-out position forming a platform which is located at least approximately at the height of the floor of the machine housing compartment, the soiled water container being removable from the machine housing compartment via the said platform and again being introducable into the machine housing compartment through the agency of said platform.

7. The floor cleaning machine as defined in claim 6, wherein the pivotable cover comprises a floor support for the said soiled water container which is located in a recessed position at the outer surface of the machine housing when the machine is ready for use.

8. The floor cleaning machine as defined in claim 1 further including means for urging the marginal edge of the portable soiled water container into contact against the seal at the intermediate element and sealingly enclosing the suction compartment opening when the housing cover which closes the machine housing compartment containing the soiled water container is closed, and wherein when the housing cover is open the seal is relieved of the contact pressure and the soiled water container in the compartment can be removed from therein.

9. The floor cleaning machine as defined in claim 8, wherein upon closing of the pivotable cover of the soiled water compartment the compartment floor which supports the soiled water container together with the container are raised and thereby compresses the seal, and upon opening the pivotable cover the compartment floor is sufficiently lowered to permit removal of the container from within the housing.

10. The floor cleaning machine as defined in claim 1, further including a floor suction nozzle means for sucking up the water from on the surface of the floor and suction conduit extending from said floor suction nozzle means, said suction conduit opening at least approximately horizontally at a lateral location into the suction compartment which spans over the soiled water container, said collar being annular and having a drip edge which extends downwardly from the ceiling of the suction compartment spanning the soiled water container.

11. The floor cleaning machine as defined in claim 10, wherein said collar widens in its inner dimension from the top towards the bottom and with its lower drip edge extending in spaced relationship with respect to said outer wall, and wherein any splashing water from the soiled water container impacts against an inner surface of the collar and again falls back via the collar drip edge into the soiled water container.

12. The floor cleaning machine as defined in claim 1, wherein said collar sub-divides the soiled water stream flowing into the suction compartment into partial streams which collectively flush the entire periphery of an annular compartment between the collar and the outer wall of the suction compartment, so that such soiled water stream is distributed over the entire periphery and drops along the outer wall into the soiled water container.

13. The floor cleaning machine as defined in claim 1, said flow direction changing members comprising a number of sealingly stacked body members.

14. The floor cleaning machine as defined in claim 1, further including a large surface filter body mounted in the air flow path through the flow direction changing members and serving to separate out residual portions of water particles from the suction air.

15. The floor cleaning machine as defined in claim 1, further including a flexible hose leading from the suction compartment of the suction blower to a floor suction nozzle arrangement, said flexible hose being detachable from the floor suction nozzle arrangement and being connectable to a suction conduit immersible in the fresh water container, so that the fresh water container can be emptied with the same suction blower and wherein the water removed from the fresh water container flows into the soiled water container and can be carried together therewith to a drain.

* * * * *